US006848484B1

(12) United States Patent
Darr

(10) Patent No.: US 6,848,484 B1
(45) Date of Patent: Feb. 1, 2005

(54) MEASURING CUP AND CAP FOR LIQUID DISPENSING PACKAGE

(75) Inventor: Richard C. Darr, Medina, OH (US)

(73) Assignee: Plastipak Packaging, Inc., Plymouth, MI (US)

( * ) Notice: Subject to any disclaimer, the term of this patent is extended or adjusted under 35 U.S.C. 154(b) by 0 days.

(21) Appl. No.: 10/644,444

(22) Filed: Aug. 20, 2003

(51) Int. Cl.[7] ..... B65B 1/04
(52) U.S. Cl. ..... 141/381; 222/109; 222/571
(58) Field of Search ..... 141/369, 379–381; 222/108–11, 552, 554, 562, 563, 566, 570, 571

(56) References Cited

U.S. PATENT DOCUMENTS 2,584,522 A * 2/1952 Wolf ..... 141/381
4,917,269 A * 4/1990 Fuchs et al. ..... 222/109
5,020,692 A * 6/1991 Darr ..... 222/109
5,060,827 A * 10/1991 Segati ..... 222/109
5,794,803 A * 8/1998 Sprick ..... 215/217

* cited by examiner

*Primary Examiner*—Steven O. Douglas
(74) *Attorney, Agent, or Firm*—Robert H. Bachman

(57) ABSTRACT

A measuring cup adapted to serve as a closure for a package for liquids and a package for liquids including a container, a transition collar and a measuring cup adapted to serve as a closure. The measuring cup has a closed base and an open mouth, with an upper wall portion surrounding said open mouth. A side wall portion extends between the closed base and upper wall, wherein the side wall is disposed outwardly of the upper wall to provide an increased volume measuring cup.

20 Claims, 3 Drawing Sheets

MEASURING CUP AND CAP FOR LIQUID DISPENSING PACKAGE

BACKGROUND OF THE INVENTION

The present invention relates to an improved measuring cup adapted to serve as a closure for liquid products and a package for liquids including the measuring cup.

Considerable effort has been directed to packages for liquids including a container housing the liquid, a transition collar having a pouring spout mounted on the container outlet, and a measuring cup which serves as a closure for the container. For example, U.S. Pat. No. 4,550,862 shows a liquid product pouring and measuring package having a measuring cup which also serves as the closure for the package. The package includes a container including a container body with an upwardly extending finish and a dispensing orifice. A transition collar is mounted on the container finish and has a pouring spout and a circumscribing wall with fastening means on its interior surface. A measuring cup serves as a closure for the package and includes outwardly disposed fastening means adapted to mate with the inwardly facing fastening means on the transition collar to attach the measuring cup in the inverted position to the transition collar and thereby provide a closure for the package.

However, it would be desirable to provide an improved package including the container, transition collar and measuring cup, and an improved measuring cup for use with said package, with the measuring cup having a more versatile configuration.

It is therefore a principal object of the present invention to provide an improved package for liquids including a container for housing liquids, a transition collar having a pouring spout mounted on the container outlet, and a measuring cup which serves as a closure for the container.

It is also a principal object of the present invention to provide an improved measuring cup which serves as a closure for a container-transition collar combination as aforesaid.

Further objects and advantages of the present invention will appear hereinbelow.

SUMMARY OF THE INVENTION

In accordance with the present invention the foregoing objects and advantages are readily obtained.

The measuring cup of the present invention is adapted to serve as a closure for a package for liquids and comprises: a closed base and an open mouth, with an upper wall portion surrounding said open mouth; fastening means formed on the external surface of said upper wall; a sidewall portion extending between the closed base and upper wall with an outwardly extending connecting wall portion connecting said side wall and upper wall, said connecting wall being outwardly oriented with respect to said upper wall at an angle of less than 90° with respect to said upper wall so that the side wall is disposed outwardly of the upper wall to provide an increased volume measuring cup. Desirably the fastening means are a threaded portion which surrounds the open mouth, and desirably the outwardly disposed angle of the connecting wall is from 5° to 45°. Also, preferably an outwardly extending shoulder is provided on the upper wall located between the fastening means and connecting wall. The side wall is substantially larger than the upper wall and connecting wall combined so that the side wall represents the major wall portion of the measuring cup to provide a desirable large volume capacity.

In addition to the foregoing, the present invention provides an improved package for liquids including the foregoing measuring cup in combination with the following: a container for housing a liquid having an upwardly extending finish provided with a dispensing orifice; and a transition collar mounted on the exterior of said container finish, said collar having an outwardly projecting pouring spout and a circumscribing wall with fastening means formed on its interior surface to cooperate with the fastening means on said measuring cup, wherein the pouring spout extends above and is spaced from the circumscribing wall.

Further features of the present invention will appear hereinbelow.

BRIEF DESCRIPTION OF THE DRAWINGS

The present invention will be more readily understandable from a consideration of the accompanying drawings, wherein.

DETAILED DESCRIPTION OF PREFERRED EMBODIMENTS

Figure 1:
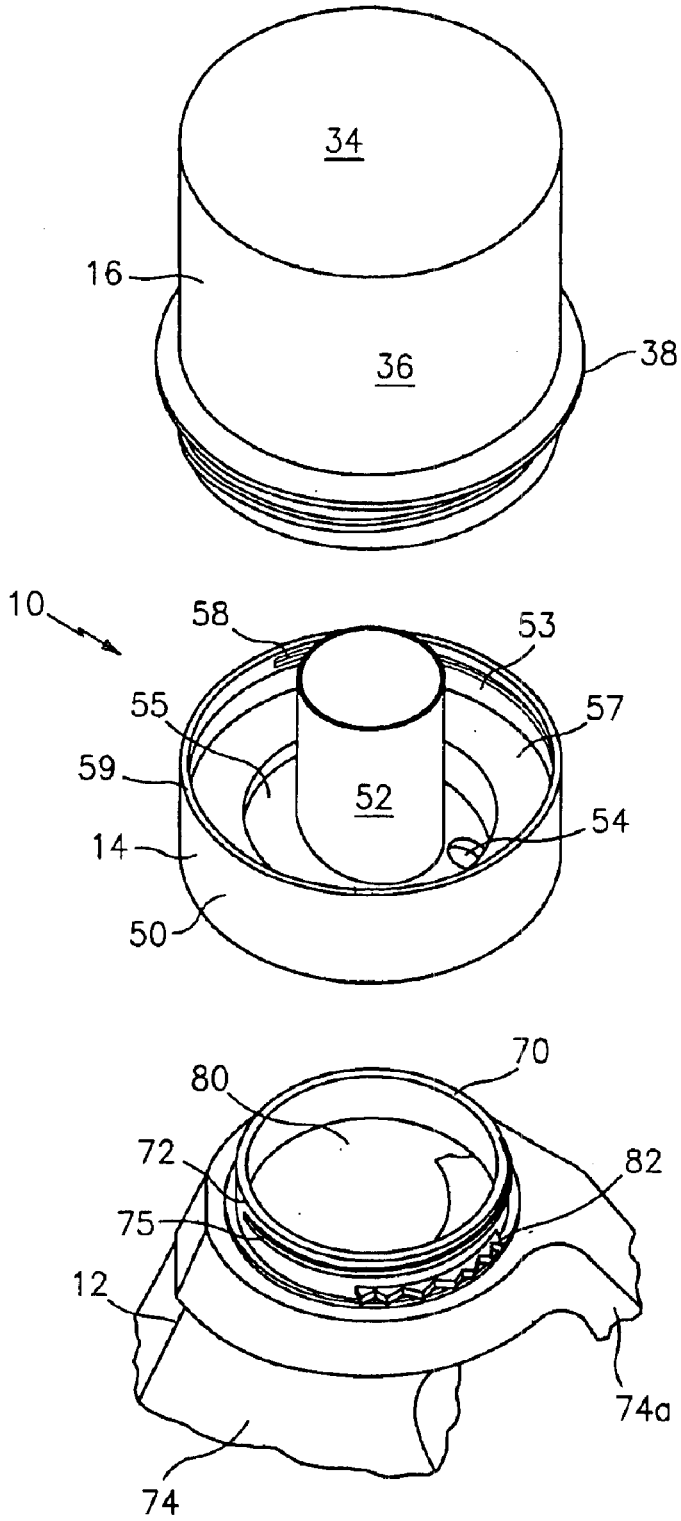
FIG. 1 (PRIOR ART)
FIG. 1 is a fragmentary, exploded, perspective view of a prior art package for holding and dispensing liquids including a container, transition collar and measuring cup which acts as a closure.
Figure 2:
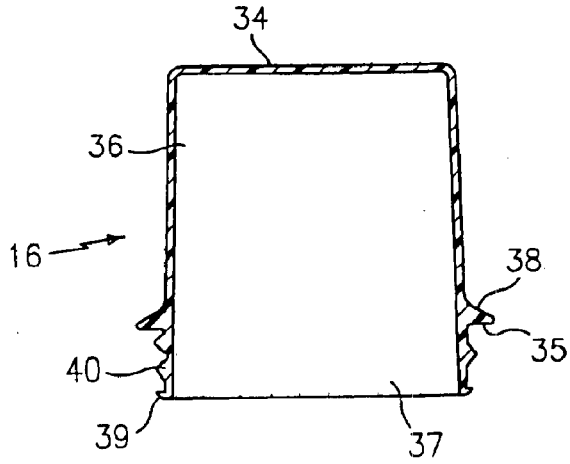
FIG. 2 (PRIOR ART)
FIG. 2 is a vertical cross-sectional view of the prior art measuring cup shown in FIG. 1.
Figure 3:
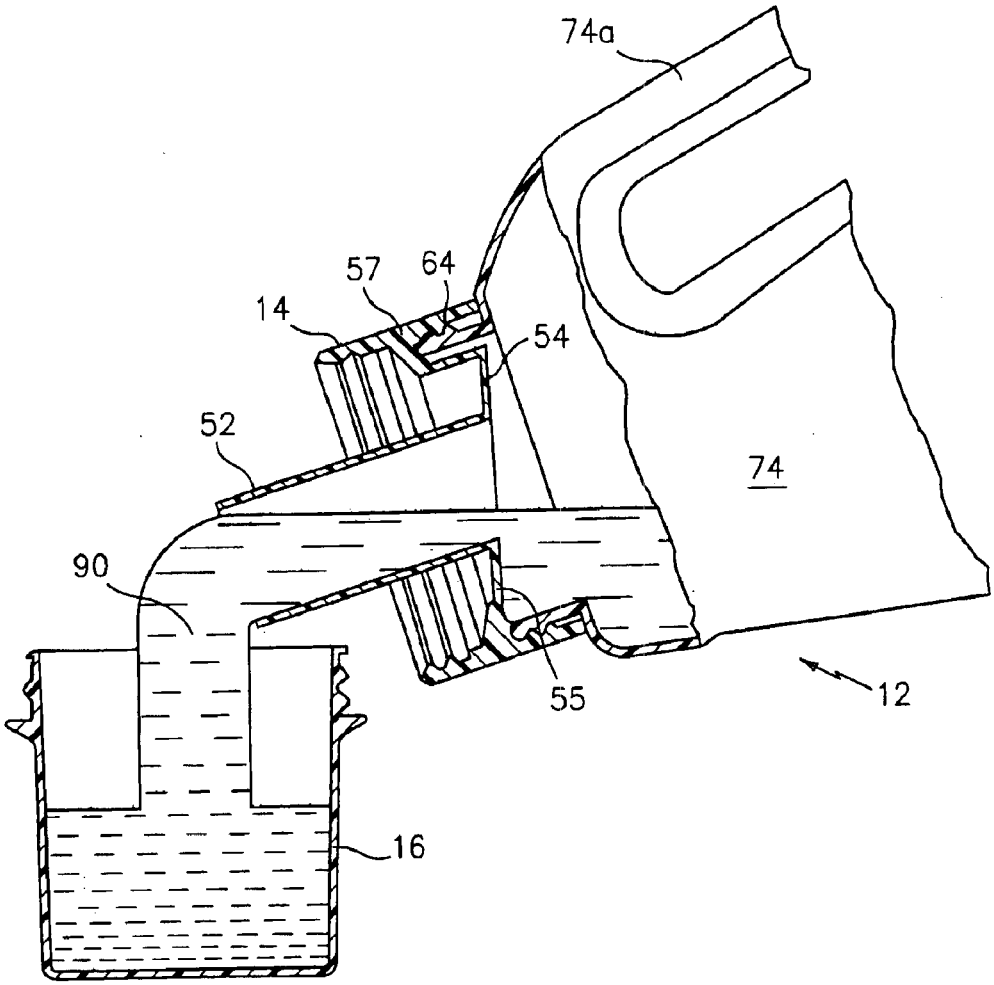
FIG. 3 (PRIOR ART)
FIG. 3 is a fragmentary, vertical cross-sectional view of the prior art package of FIG. 1 during the initial dispensing operation with the measuring cup performing its measuring operation.

Referring to the drawings, FIGS. 1–3 represent a prior art package as shown in U.S. Pat. No. 4,550,862. The prior art package 10 includes a liquid product container 12, a transition collar 14 to be mounted on the container 12, and a measuring cup 16.

The container 12, which is typically constructed of a moldable polymeric material such as polyethylene or polypropylene, has a body portion 74, an upwardly extending finish 72 and, as shown in FIG. 1, a flat annular lip 70 on the upper surface of the finish 72 defining orifice 80. The balance of the body portion 74 which is not shown in FIG. 1 provides a closed-end chamber suitable for containing the product to be dispensed. The body portion 74 desirably has an integrally molded handle 74*a* to provide a prominent or recognizable gripping or hand hold means to facilitate dispensing and to properly orient the transition collar 14 during pouring of the product.

An interlock means, comprising a plurality of locking teeth 82, is desirably located at the base of the container finish 72. These locking teeth 82 are disposed in two diametrically opposed groups of several juxtaposed ratchet-type teeth molded around the base of the container finish 72 adjacent and below the thread convolutions 75. The locking teeth 82 are designed to mate with locking teeth on the inner surface of transition collar 14 (not shown) when the transition collar is assembled onto container 12 as shown in FIG. 3.

Transition collar 14, which is typically injection molded of a thermoplastic material, such as polypropylene or the like, is slightly harder than the material of either the container 12 or the cup 16. This variance in hardness provides better sealing between the collar and the container, and the cup and the collar.

Transition has a circumscribing cylindrical outer wall portion 50, an outwardly projection tubular pouring spout 52, a drain-back shoulder 57 having a frusto conically configured upper surface and an inclined drain back partition 55. The drain back partition 55 and shoulder 57 essentially create a transverse partition which separates the outer wall portion 50 into top and bottom sections and has a hole 54 which serves as both a vent and a drain extending through the lowermost portion of drain back partition 55.

Threads 64 on the inside of transition collar 14 (see FIG. 3) cooperate with threads 75 on the outside of container finish 72 as shown in FIG. 1. As shown in the prior art embodiment of FIGS. 1–3, the threads 64 of collar 14 and threads 75 of container 12 are designed and matched so as to mount the transition collar 14 onto container 12 and to orient the vent-drain hole 54 so that it is generally radially aligned with and substantially adjacent to the hand hold means 74*a* when tightened.

Also, in the prior art embodiment shown in FIGS. 1–3, the upwardly extended pouring spout 52 is coaxial with the transition collar 14. The diameter of the pouring spout 52 should be sized for convenience in pouring the particular liquid involved, as liquid 90 shown in FIG. 3. The height of pouring spout 52 is sized to fit within the inverted cup 16 in the sealed position, the orientation of which is shown in FIG. 1.

The measuring cup 16 of the prior art embodiment is shown in FIG. 2 as being generally cup-shaped with a bottom wall 34, a depending skirt-like side wall 36, and an open mouth 37 terminating in a lip 39. The cup 16 is typically injection molded of a fairly dense polymer, such as medium to high density polyethylene, for compressive strength. Lip 39 is formed as a drip-prevention lip for cup 16 when the same is used as a measuring cup, and to be an inner seal in contact with annular interior wall 53 of the collar 14 when cup 16 is used as the closure for the package 10. Adjacent lip 39 on the external surface of said cup is an outwardly facing fastening means, as threads 40, adapted to cooperate with the inwardly facing threads 58 of collar 14.

A coaxial shoulder 38, located below the threads 40 spaced from the lip 39, projects outwardly from the exterior surface of side wall 36 and provides a sealing surface 35 adapted to contact sealing ring 59 on the upper surface of circumscribing wall 50 of collar 14 when the measuring cup 16 is fastened in inverted condition on the collar 14. In the prior art embodiment of FIG. 2 side wall 36 is coaxial with the upper portion of measuring cup 16 containing threads 40, as clearly shown.

FIG. 3 shows the prior art package of FIG. 1 during a dispensing cycle for liquid 90 housed in container 12. The removable cup 16 used as a closure for container 12 is being utilized as a measuring receptacle. When cup 16 is filled to the desired level container 12 is brought to an upright position. Once cup 16 has been emptied, the empty cup is returned to its former position as closure for container 12 in the inverted position as shown in FIG. 1.

Figure 4:
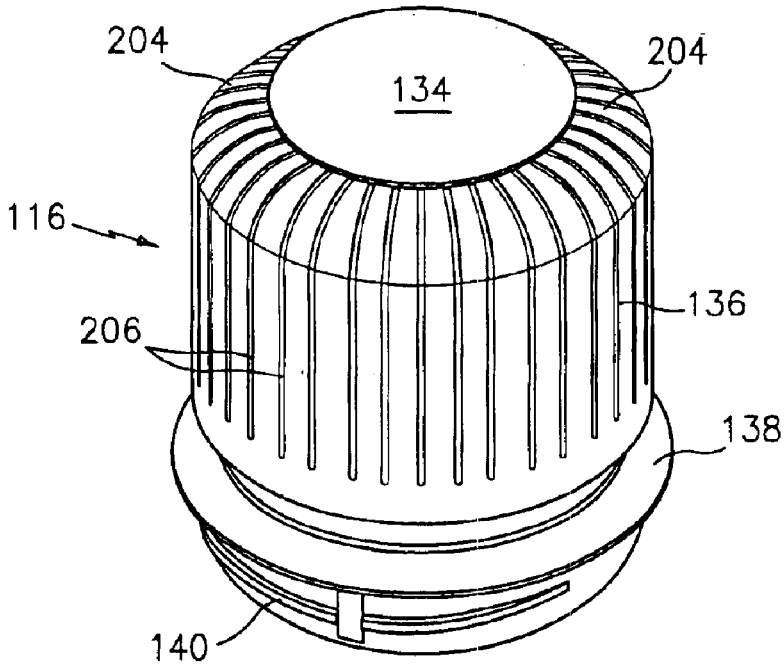
FIG. 4 is a perspective view of the measuring cup of the present invention.
Figure 5:
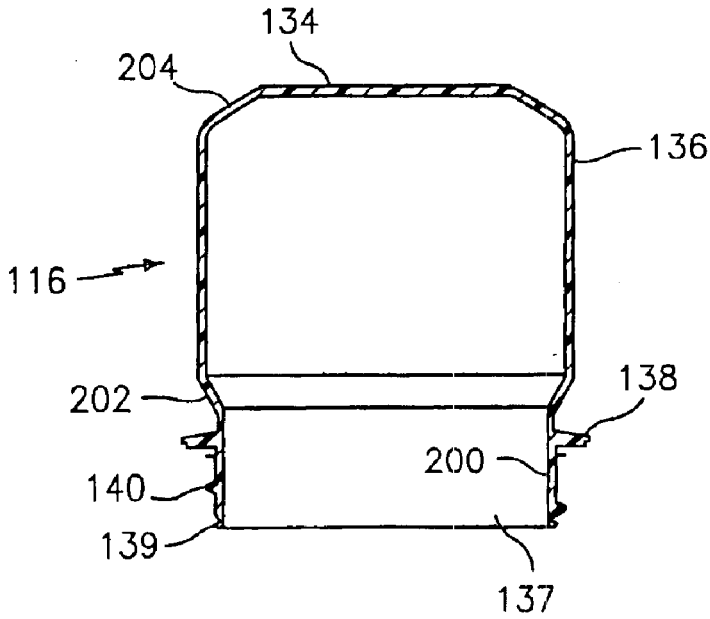
FIG. 5 is a vertical cross-sectional view of the measuring cup of the present invention as shown in FIG. 4.

FIGS. 4–5 show the improved cup 116 of the present invention which advantageously is used as a closure for container 12 and as a measuring cup.

Similar to cup 16 in FIG. 2, cup 116 in FIGS. 4–5 is generally cup shaped with a closed base or bottom wall 134, a depending skirt-like side wall 136 and an open mouth 137 terminating in a lip 139. The exact dimension of the outwardly extending lip 139 may vary, and in the embodiment shown in FIGS. 4–5 it is somewhat smaller than lip 39 in the prior art embodiment of FIG. 2, but the function is the same. Also, similar to cup 16, cup 116 is generally formed of a fairly dense polymer, as medium to high density polyethylene.

Cup 116 has an upper wall portion 200 surrounding open mouth 137 with outwardly facing fastening means, as threads 140 on the upper wall portion to cooperate with the inwardly facing threads 58 of collar 14 in the prior art embodiment of FIGS. 1–3. A coaxial shoulder 138 is located on the upper wall below threads 140 and spaced from lip 139, projecting outwardly from the exterior surface of the upper wall serving the same function as shoulder 38 in the prior art embodiment of FIG. 2.

However, in the present invention an outwardly extending connecting wall portion 202 is provided connecting the side wall 136 with the upper wall 200. Connecting wall 202 is outwardly oriented with respect to upper wall 200 at an angle of less than 90°, and generally at an angle of from 5° to 45° with respect to upper wall 200. As clearly shown in FIGS. 4–5, the outward orientation of the connecting wall 202 provides that the side wall 136, which is substantially larger than the upper wall 200, is disposed outwardly of the upper wall, providing an increased volume measuring cup without increasing the size of the upper wall portion. This enables container 116 to desirably and advantageously have an increased volume than the prior art measuring cup at the same height and with the same upper wall size configuration. This represents a considerable advantage in the art since it is desirable to provide such increased capacity with the same height to accommodate market shelf configurations, and to utilize the same upper wall size configuration to accommodate existing products.

In the embodiment of FIGS. 4–5, a curved or angled wall portion 204 is provided connecting base 134 and side wall 136, and longitudinal striations 206 are provided on the external surfaces of at least side wall 136 and preferably also angled wall 204 to provide an aesthetically pleasing design.

The improved measuring cup of the present invention can be formed by direct injection molding, or desirably by injection molding a prior art type measuring cup and using the resultant cup as a preform to form the cup of the present invention by blow molding. In the blow molded embodiment the upper wall portion would remain unchanged from the injection molded configuration, and the preform would be heated to blow molding temperature in accordance with standard procedure.

The particular embodiment of FIGS. 4–5 is representative only. The side wall portion could, if desired, be formed so that it is disposed outwardly of the upper wall portion an increased distance to provide a greater volume than that shown in FIGS. 4–5, if desired, or a smaller distance to provide a lesser volume than that shown, if desired.

It is to be understood that the invention is not limited to the illustrations described and shown herein, which are deemed to be merely illustrative of the best modes of carrying out the invention, and which are susceptible of modification of form, size, details of operation. The invention rather is intended to cations which are within its spirit and scope as defined by the

What is claimed is:

1. A measuring cup adapted to serve as a closure for a package, which comprises:

a closed base and an open mouth, with a substantially straight upper wall portion surrounding said open mouth and oriented at an angle of substantially 90° with respect to said closed base;

fastening means formed on the external surface of said upper wall;

a substantially straight side wall portion extending between the closed base and upper wall and oriented at an angle of substantially 90° with respect to said closed base, with an outwardly extending connecting wall portion connecting said side wall and upper wall, said connecting wall being outwardly oriented with respect to said upper wall at an angle of less than 90°, whereby the side wall is disposed outwardly of the upper wall in a substantially straight line between the upper wall and closed base to provide an increased volume measuring cup without increasing the height of the measuring cup.

2. A measuring cup according to claim 1, wherein the side wall portion has a greater length than the length of the upper wall portion and connecting wall portion combined.

3. A measuring cup according to claim 2, including an outwardly extending shoulder on the upper wall portion located between the fastening means and connecting wall portion.

4. A measuring cup according to claim 2, wherein said fastening means comprise a threaded portion which surrounds said open mouth.

5. A measuring cup according to claim 2, wherein said angle of the connecting wall is from 5° to 45°.

6. A measuring cup according to claim 2, including an angled wall portion connecting said closed base and side wall portion.

7. A measuring cup according to claim 2, including longitudinal striations on the external surface of said side wall portion.

8. A measuring cup according to claim 6, including longitudinal striations on the external surface of said angled wall portion and side wall portion.

9. A measuring cup according to claim 2, wherein said measuring cup is blow molded.

10. A measuring cup according to claim 2, wherein the side wall is disposed outwardly of the upper wall portion to provide an increased volume measuring cup without increasing the size of the upper wall portion.

11. An improved package for liquids, which comprises:

a container for housing a liquid having an upwardly extending finish provided with a dispensing orifice;

a transition collar mounted on the exterior of said container finish, said collar having an outwardly projecting pouring spout and a circumscribing wall, wherein the pouring spout extends above the circumscribing wall;

a measuring cup adapted to serve as a closure for said package, including a closed base and an open mouth, with a substantially straight upper wall portion surrounding said open mouth and oriented at an angle of substantially 90° with respect to said closed base, fastening means formed on the external surface of said upper wall, and a substantially straight side wall portion extending between the closed base and upper wall and oriented at an angle of substantially 90° with respect to said closed base, with an outwardly extending connecting wall portion connecting said side wall and upper wall, said connecting wall being outwardly oriented with respect to said upper wall at an angle of less than 90°, whereby the side wall is disposed outwardly of the upper wall in a substantially straight line between the upper wall and closed base to provide an increased volume measuring cup without increasing the height of the measuring cup.

12. An improved package according to claim 11, wherein the side wall portion of said measuring cup has a greater length than the length of the upper wall and connecting wall portions of said measuring cup combined.

13. An improved package according to claim 12, wherein said angle of the connecting wall is from 5° to 45°.

14. An improved package according to claim 12, wherein said measuring cup includes an angled wall portion connecting said closed base and side wall portion.

15. An improved package according to claim 12, including longitudinal striations on the external surface of the side wall portion of the measuring cup.

16. An improved package according to claim 14, including longitudinal striations on the external surface of said angled wall and side wall portions of said measuring cup.

17. An improved package according to claim 12, wherein said measuring cup is blow molded.

18. An improved package according to claim 12, wherein said transition collar includes a drain back shoulder having a frusto conically configured upper surface, an inclined drain back partition and vent hole.

19. An improved package according to claim 18, wherein said container includes a hand hold means, and wherein said vent hole is generally radially aligned with said hand hold means when the transition collar is tightened onto the container.

20. An improved package according to claim 12, wherein the pouring spout is spaced from and extends above the circumscribing wall of the transition collar, is coaxial with the circumscribing wall of the transition collar, and the height of the pouring spout is sized to fit within the measuring cup when the measuring cup is disposed as a closure.

* * * * *